United States Patent [19]

Stein et al.

[11] Patent Number: 4,833,952

[45] Date of Patent: May 30, 1989

[54] TORQUE LIMITING SCREW-TIGHTENING TOOL

[75] Inventors: Dieter Stein, Oberkochen; Eugen Mattheiss, Lauchheim, both of Fed. Rep. of Germany

[73] Assignee: Cooper Industries, Inc., Houston, Tex.

[21] Appl. No.: 124,660

[22] Filed: Nov. 24, 1987

Related U.S. Application Data

[63] Continuation of Ser. No. 876,519, Jun. 20, 1986, abandoned.

[51] Int. Cl.[4] ..... B25B 23/157

[52] U.S. Cl. ..... 81/474; 81/475; 81/473

[58] Field of Search ..... 81/469, 470, 471, 473, 81/474, 475

[56] References Cited

U.S. PATENT DOCUMENTS

| | | | |
|---|---|---|---|
| 2,724,299 | 11/1955 | Amtsberg | 81/475 |
| 2,728,252 | 12/1955 | Connell | 81/475 |
| 2,884,103 | 4/1959 | Connell | 81/475 |
| 2,963,134 | 12/1960 | Banner | 81/474 |

*Primary Examiner*—James G. Smith

*Attorney, Agent, or Firm*—Alan R. Thiele; Eddie E. Scott

[57] ABSTRACT

A power-operated tool is fitted with a drive, whose driving shaft can, by means of a connecting coupling whose actuation depends on the reaction torque, be coupled with a driven shaft. The connecting coupling first interrupts transfer of the torque to the driven shaft, so that, in spite of the running drive, no torque can be transferred to the driving shaft. Immediately afterwards, the drive is disconnected. As a result of this sequence of disconnections, the motor, which continues running, can no longer have any influence on the work in progress so that the fastener being tightened does not reach the point of plastic deformation.

4 Claims, 4 Drawing Sheets

TORQUE LIMITING SCREW-TIGHTENING TOOL

This is a continuation of co-pending application Ser. No. 876,519 filed on June 20, 1986 now, abandoned.

FIELD OF THE INVENTION

The invention concerns a power-operated tool, preferably a torque limiting screw-tightening tool.

BACKGROUND

In the case of known torque-limiting, power operated, screw tightening tools, torque is transferred from the driving shaft via a connecting coupling to the driven shaft. The driven side of the connecting coupling is coupled to the driven shaft by means of a ball and groove system. Specifically, one or more balls simultaneously engage specially shaped grooves and/or pockets in the connecting coupling. When such known tools are used for tightening a screw, the balls, move in the grooves as torque increases. Because the grooves rise in the direction of rotation, the driven side of the connecting coupling is, displaced axially toward its disconnect position as torque increases. The connecting coupling is actuated at a preset reaction torque to disconnect the drive. If the connecting coupling is not disengaged as close as possible to the point in time when the preset reaction torque is reached, torque may still be transferred to the driven shaft. This remaining torque may continue turning the fastener so that the desired elastic region is exceeded and the fastener is deformed in a plastic manner.

In such prior art tools, claws on both sides of a connecting coupling bear against each other with increasingly smaller surfaces. Consequently, the claws of the connecting coupling experience increased wear. In addition, even after the driven parts are disconnected from the driver, the torque still affects the driven shaft so that the driven shaft may be exposed to uncontrolled movements.

The task of the present invention is to provide a torque-limiting, power operated, screw tightening tool which, upon attainment of a predetermined torque, disconnects transfer of the torque to the driven shaft completely thus avoiding plastic deformation of the fastener by transfer of residual or remaining torque to the fastener after the predetermined level of torque has been reached.

SUMMARY OF THE INVENTION

The torque-limiting, power driven, screw tightening tool of to the present invention prevents over torquing of fasteners by using two connecting coupling assemblies which operate in succession to completely disconnect transfer of torque after a predetermined level has been reached. By means of a torque connecting coupling assembly, transfer of the torque from the driving shaft to the driven shaft is almost instantaneously interrupted, so that, even with the drive motor running, torque is no longer transferred to the driven shaft. Immediately afterwards interrupting the flow of torque to the driven shaft, drive connecting coupling assembly disconnects the flow of torque from the tool drive motor.

In the tool of the present invention, rapid disconnect is achieved by separating the operation of disconnecting the torque and disconnecting the drive. Consequently, the motor, even though still running, no longer has any influence on the screw tightening process. Specifically, after the torque connecting coupling assembly is deactivated when the tightened screw, nut, or the like is tightened to the desired level of torque, no more torque can be transferred from the still running drive motor, so that the desired turning force affecting the screw, nut, or the like, can be limited to a high degree of accuracy. In the tool of the present invention, one set of claws of the connecting coupling are always fully engaged to assure maximum overlapping of torque transfer by the claws. When the connecting coupling is to be separated, the coupling assemblies can be suddenly moved, so that the claws are mutually released. This makes the wear of the claws practically impossible.

A further understanding of the characteristics of the prevent invention will follow from the claims, from the description and drawings.

BRIEF DESCRIPTION OF THE DRAWINGS

The invention is described with more detail according to the example shown in the drawings.

DESCRIPTION OF THE PREFERRED EMBODIMENTS

The torque-limiting, power-operated, screw tightening tool 100 of the present invention is designed to be a hand held tool or part of a large machine for tightening multiples of screws. In the example shown, screw-tightening tool 100 is operated by compressed air. Tool 100 can be also driven by an electric motor.

Figure 1:
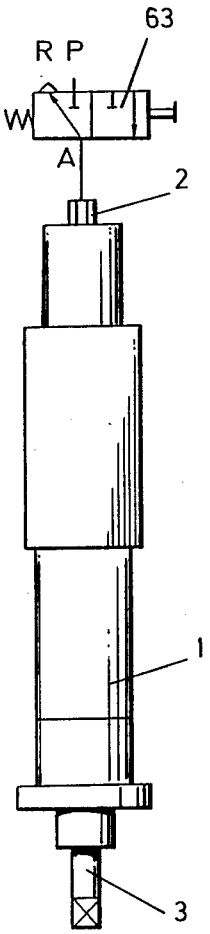
FIG. 1 is a schematic of a power-operated tool according to the invention.

According to FIG. 1, screw-tightening tool 100 is fitted with housing 1 and provided at one end with control connection 2 for compressed air. Tool 100 is provided at the other end with driven part 3, on which a screw tool, a socket, or the like, can be fitted. In housing 1, compressed-air motor 4 (FIG. 2) is mounted. Connecting tappet 5 passes through motor 4. Compressed air flows through duct 6 in housing 1 to circular abutment 7 having portholes 8 for the passage of compressed air. Portholes 8 connect duct 6 with valve chamber 9, inside which rotary piston 10 can slide against the force of pressure spring 11. In the upper half of FIG. 2, rotary piston 10 is shown in the position it assumes during operation of screw-tightening tool 100. In the lower half of FIG. 2, rotary piston 10 is shown in its starting position in which it sealingly bears against valve disk 12 at one end of connecting tappet 5. Rotary piston 10 is guided along inside wall 13 of valve chamber 9 and is fitted slidingly on valve seat 14. Pressure spring 11 rests with one end on shoulder 15 of valve seat 14 and, with the other end, on shoulder 16 of rotary piston 10. Connecting tappet 5 passes through valve seat 14. Compressed air can flow from duct 6 via portholes 8 and valve chamber 9 through valve seat 14 to motor 4. Driving motor 4 provides a rotary drive for hollow spindle 17. Connecting tappet 5 projects into hollow spindle 17. Hollow spindle 17 is supported in a rotary manner in housing 1 by at least one bearing 18. On hollow spindle 17 is fitted driving side coupling part 19 of drive connecting coupling assembly 20. Driving side coupling part 19 is seated slidingly on hollow spindle 17 against the force of pressure spring 21. Pressure spring 21 surrounds hollow spindle 17 with a spacing therebetween and is supported by driving side coupling part 19 and by ring 22 attached to hollow spindle 17. On the face turned away from compressed-air motor 4, driving side coupling part 19 includes coupling claws 23 (FIG. 3*a*), which engage the coupling claws 24 of first intermediate coupling part 25. First intermediate coupling part 25 is fitted in an axially sliding manner, on hollow spindle 17 and constitutes, together with driving side coupling part 19, drive connecting coupling assembly 20. First intermediate coupling part 25 (as shown in FIG. 3*a*) rests with shoulder 26, directed radially inwards, on reduced diameter section 27 of hollow spindle 17. In the area outside of shoulder 26, first intermediate coupling part 25 surrounds reduced diameter spindle section 27. Consequently, annulus 28 is formed between first intermediate coupling part 25 and reduced diameter spindle section 27, in which annulus 28, pressure spring 29 is fitted. Spring 29 rests with one end on the radially inward-pointed shoulder 26 and, with the other end, on the radially outward-running shoulder surface 30 of hollow spindle 17. Shoulder surface 30 is provided at the transition point between reduced diameter spindle section 27, and larger spindle section 31. Driving side coupling part 19 is seated slidingly on spindle section 31. As shown in FIG. 3*a*, first intermediate coupling part 25 rests with its coupling claws 24 also on spindle section 31 when screw tightening tool 100 is in its operating mode.

Figure 2:
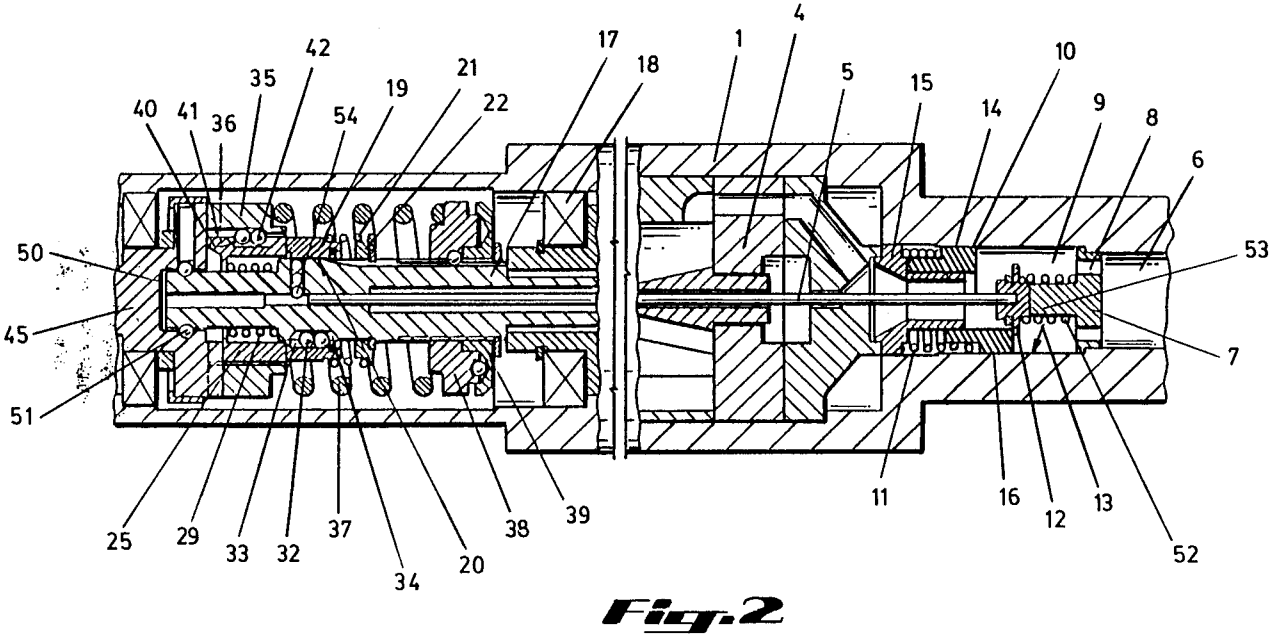
FIG. 2 is an axial section of the tool shown FIG. 1.
Figure 3A:
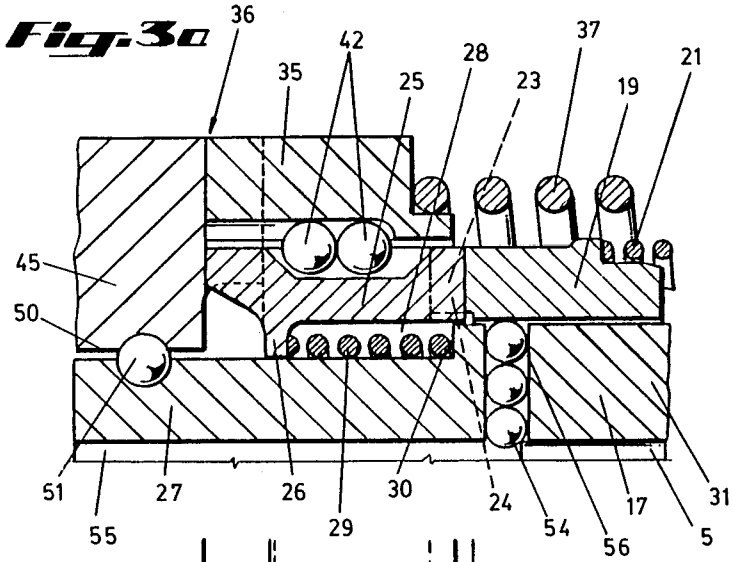
FIG. 3*a* is an enlarged representation of the positions of the drive and torque connecting coupling assemblies of the tool when the tool is in its operating position.

Driving side coupling part 19 is coupled with hollow spindle 17 in a torsion-proof manner via at least one coupling piece 32 (FIG. 2). On their faces pointed towards each other, hollow spindle 17 and driving side coupling part 19 are provided with axially parallel recesses 33 and 34, in which coupling piece 32 rests. In the illustrated example, two coupling pieces 32, designed preferably as balls, engage mutually opposite recesses 33 and 34. In order to ensure a reliable and low-wear transfer of torque from hollow spindle 17 to driving side coupling part 19, more of such axially parallel recesses 33 and 34 with coupling pieces 32 in them may be provided on the periphery of the hollow spindle and driving side coupling part 19. Torque is transferred via these recesses 33 and 34 from hollow spindle 17 to driving side coupling part 19. Because, in its coupling position, coupling part 19 engages first intermediate coupling part 25 via coupling teeth 23 and 24, first intermediate coupling part 25 is, in its operating position, revolvingly carried along.

Against first intermediate coupling part 25 is matingly fitted second intermediate coupling part 35 of torque connecting coupling assembly 36. Second intermediate coupling part 35 slides on first intermediate coupling part 25 against the force of pressure spring 37 surrounding hollow spindle 17. Pressure spring 37 rests with one end on a face of second intermediate coupling part 35 and, with its other end, on centering disk 38 which is fitted on hollow spindle 17. Due to the force of pressure spring 37, centering disk 38 bears against nut 39 which threadably engages hollow spindle 17. Nut 39 can be used for pre-stressing pressure spring 37.

Figure 4A:
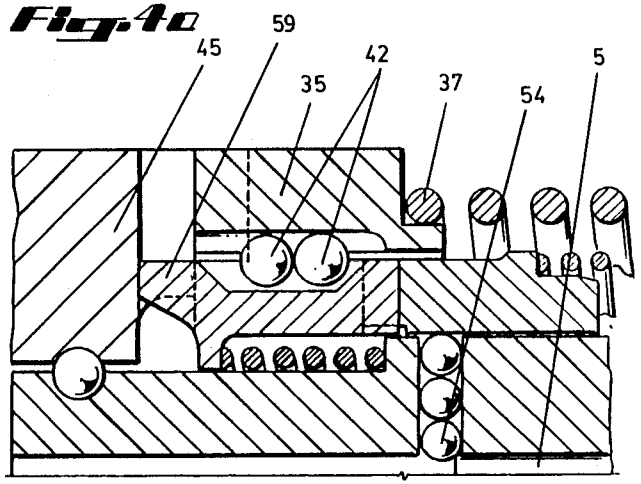
FIG. 4*a* is an enlarged representation similar to FIG. 3*a*, wherein transfer of the torque from the driving spindle of the tool to the driven shaft is interrupted by the torque connecting coupling assembly.
Figure 4B:
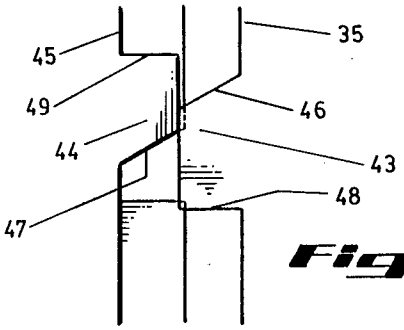
FIG. 4*b* is a schematic similar to FIG. 3*b* illustrating the torque connecting coupling assembly when the transfer of torque is interrupted according to FIG. 4*a;*

Intermediate coupling parts 25 and 35 are provided with at least one axially parallel groove 40, 41, into which at least one ball coupling piece 42 engages. It is preferable to have more of such axially parallel grooves distributed on the periphery of intermediate coupling parts 25 and 35. In grooves 40 and 41, two ball coupling pieces 42 always rest. Second intermediate coupling part 35 of torque connecting coupling assembly 36 is rotatably coupled with first intermediate coupling part 25 of drive coupling assembly 20 by ball coupling pieces 42. On the face of second intermediate coupling part 35 turned away from pressure spring 37, second intermediate coupling part 35 is also equipped with coupling claws 43 (FIG. 3*a*, 3*b*, 4*b*). Coupling claws 43 act together with coupling claws 44 of driven side connecting part 45 of torque connecting coupling assembly 36. Via the mutually engaging coupling claws 43, 44, two coupling parts 35 and 45 of torque connecting coupling assembly 36 are rotatably intercoupled. One of the two faces 46 and 47 (FIGS. 3*b* and 4*b*) of mutually engaging claws 43 and 44, pointed in rotating direction, is sloping, while the opposite faces 48, 49 (FIGS. 3*b* and 4*b*) are axially parallel.

Hollow spindle 17 projects into central recess 50 of driven side coupling part 45, in which recess the hollow spindle 17 is pivotably supported by means of detachable ball journal bearing 51.

During operation of screw-tightening tool 100, compressed air is supplied to compressed-air motor 4 in the described manner. Due to the pressure existing in valve chamber 9, rotary piston 10 is displaced against the force of pressure spring 11 toward motor 4 into the position shown in the upper half of FIG. 2, in which position compressed air can flow under valve disk 12 through valve seat 14 to compressed-air motor 4. Connecting tappet 5 is biased via pressure spring 52 in the direction of compressed-air motor 4. Pressure spring 52 surrounds a central lug 53 of circular abutment 7 and rests with one end on valve disk 12 and, with its other end, on circular abutment 7.

The end of connecting tappet 5 rests in the bore of hollow spindle 17 and bears, due to the force of pressure spring 52 and the hydraulic pressure existing in valve chamber 9, against lower ball stop member 54 (FIGS. 2 and 3*a*). Ball stop member 54 projects into central bore 55 of hollow spindle 17. Ball stop member 54 is formed by at least one ball 54 fitted in cross bore 56 of hollow spindle 17, which ball 54 is secured against dropping out of cross bore 56. In the example shown, cross bore 56 contains three ball members 54. These three ball members 54 are biased radially outwardly by connecting tappet 5, and are held in position by driving side coupling part 19, which overlaps cross bore 56 and prevents the travel of ball members 54 radially outward. In this manner, connecting tappet 5 is supported against the force of pressure spring 52 and against the pressure existing in valve chamber 9. As a result, valve disk 12 remains lifted off rotary piston 10, so that air supply to compressed-air motor 4 is secured. Via coupling pieces 32, driving side coupling part 19 is connected with hollow spindle 17 in a torsion-proof manner. Its coupling claws 23 engage the opposite recesses of first intermediate coupling part 25. First intermediate coupling part 25 is rotatably coupled via coupling pieces 42 with second intermediate coupling part 35 of torque dependent connecting coupling assembly 36, so that, in the described manner, torque is transferred from hollow spindle 17 to second intermediate coupling part 35. Because second intermediate coupling part 35 is engaged via its coupling claws 43 with coupling claws 44 of driven side coupling part 45, driven side coupling part 45 is carried along in the rotating direction of hollow spindle 17. Driven side coupling part 45 is preferably made as one piece with driven part 3, so that the tool fitted there on is rotatably carried along.

Figure 3C:
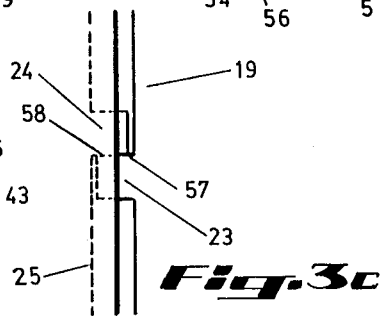
FIG. 3*c* is a schematic illustrating the engagement of the claws in the drive connecting coupling assembly.
Figure 3B:
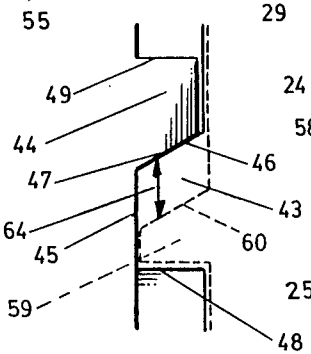
FIG. 3*b* is a schematic illustrating the engagement of the claws in the torque connecting coupling assembly.

Coupling claws 23 and 24 of intermediate coupling parts 19 and 25 are fitted with mutually parallel faces 57 and 58, which run together axially as shown in FIG. 3*c*. Faces 57 and 58 bear against each other. Driving side coupling part 19 is biased by pressure spring 21 to its coupling position, so that first intermediate coupling part 25 is carried along by torque. First intermediate coupling part 25, in turn, is affected by the force of pressure spring 29, bearing against driven side coupling part 45 of torque connecting coupling assembly 36. On its face, first intermediate coupling part 25 is also provided with coupling claws 59 (FIG. 3*b*) which engage coupling claws 44 of driven side coupling part 45, but take no part in the transfer of torque.

As shown in FIG. 3*b*, coupling claws 59 of first intermediate coupling part 25 lie with space 64 between them and the faces of coupling claws 43 and 44. Front face 60 of first intermediate coupling part 25 rises in the rotating direction and is parallel to face 47 of coupling claws 44 of driven side coupling part 45. During operation, the slanting faces 46 and 47 of coupling claws 43 and 44 of second intermediate coupling part 35 and 45 driven side coupling part bear against each other, so that torque is transferred to driven part 3.

Figure 7:
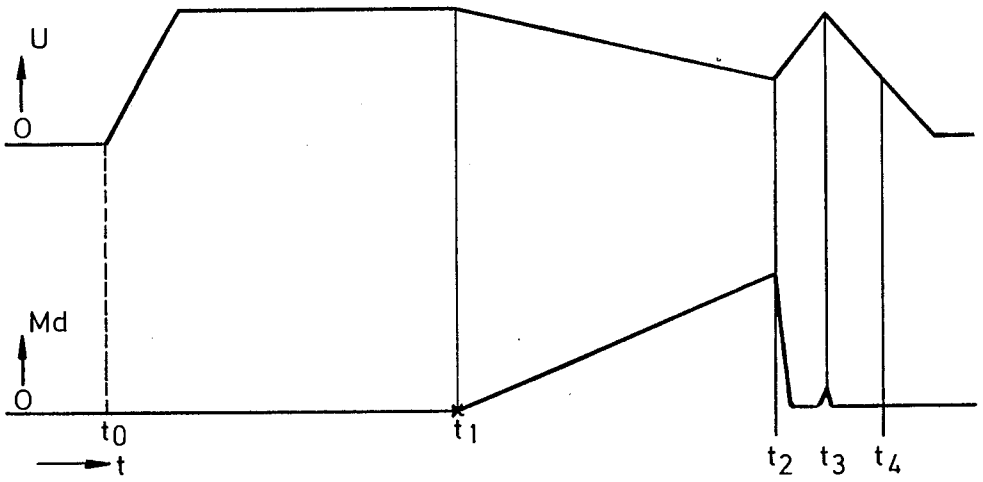
FIG. 7 is a graph of the level of torque transferred compared to time and/or tool revolutions.

The screw-tightening process will be explained, using FIG. 7. In FIG. 7, torque $M_d$ is plotted against time t during the screw-tightening process. In addition, revolutions U of the screw-tightening tool are represented as dependent on torque $M_d$. At time $t_0$, the screw-tightening tool is put in operation. As a rule, torque remains approximately zero up to time $t_0$.

During this period before $t_0$, the screw is tightened until its head rests on a surface. This is the case at time $t_0$. During continued rotation of the fastener, only torque $M_d$ increases, because, at this moment, the screw undergoes elastic strain and, possibly at the end of the screw-tightening process, plastic deformation as well. During this phase, coupling elements 19, 25, 35, 45 take the positions shown in FIGS. 3*a* through 3*c*. Driving side coupling element 19 and first intermediate coupling element 25 of drive coupling assembly 20 engage their coupling claws 23 and 24 into each other, while second intermediate coupling part 35 and driven side coupling part 45 of torque coupling assembly 36 bear against each other with slanting faces 46 and 47. Coupling claws 59 of first intermediate coupling part 25 lie with their slanting front faces 60 facing one another and with spacing 64 and the slanting faces 47 of coupling claws 44 of driven side coupling part 45 between them.

Using pressure spring 37, torque is adjusted to the level at which the transfer of torque is to be interrupted. As shown in the diagram in FIG. 7, torque $M_d$ increases from time $t_1$, until time $t_2$. When the extreme torque is reached, the screw-tightening process must stop in order to avoid excessive plastic deformation of the fastener. The initial pre-stressing of pressure spring 37 is adjusted for this extreme torque by means of nut 39. When the extreme torque is reached, the force of pressure spring 37 is no longer strong enough to transfer torque via mutually engaging coupling claws 43, 44 onto driven side coupling part 45. Second intermediate coupling part 35 is then twisted relative to driven side coupling part 45, whereby slanting faces 46 and 47 of coupling claws 43, 44, slide together. During this transition, second intermediate coupling part 35 is axially displaced against the force of pressure spring 37, until coupling claws 43 are released from coupling claws 44. Because, second intermediate coupling part 35 remains coupled via coupling pieces 42 with first intermediate coupling part 25 during this axial displacement, second intermediate coupling part 35 is twisted relative to coupling part 45 as soon as its coupling claws 43 are released from driven side coupling part 45. This done, coupling claws 43 bear against coupling claws 44 of driven side coupling part 45 (FIGS. 4*a* and 4*b*). At this moment, the transfer of torque from hollow spindle 17 to driven side coupling part 45, and consequently onto driven part 3, is interrupted. This disconnecting of second connecting coupling assembly 36 occurs at time $t_2$ (FIG. 7), whereupon torque $M_d$ immediately drops to zero. The axial displacement of second intermediate coupling part 35 is facilitated by ball-shaped coupling pieces 42. Due to the initial pre-stressing of pressure spring 37, it is easy to determine the torque at which the transfer of torque will be automatically interrupted. The inclination of faces 46 and 47 and coupling claws 43, 44 is critical for interruption of torque. The steeper these surfaces, the larger the torque at which the connecting coupling assembly 36 is released.

During the described interruption of the transfer of torque, compressed-air motor 4 is not disconnected, but keeps running. Because connecting tappet 5 still bears against ball stops 54 (FIG. 4*a*), valve disk 12 is prevented, under the pressure in valve chamber 9, from reaching its closed position.

During the relative twisting between second intermediate coupling part 35 and driven side coupling part 45, coupling claws 59 of first intermediate coupling part 25 come to bear with their slanting faces 60 against the corresponding slanting faces 47 of coupling claws 44 of driven side coupling part 45, as soon as coupling claws 43 of second intermediate coupling part 35 rest on coupling claws 44.

This mutually opposing position of the coupling claws 43 and 44 is shown in FIG. 4*b*. Because pressure spring 29, by which first intermediate coupling part 25 is pressed into its coupling position, is much weaker than pressure spring 37, first intermediate coupling part 25 is, immediately after bearing against coupling claws 44 of driven side coupling part 45, displaced axially against the force of pressure spring 29, whereby its coupling claws 59, with slanting faces 60 are displaced vis-a-vis the slanting faces 47 of coupling claws 44 until coupling claws 59, too, bear against coupling claws 44.

Figure 5A:
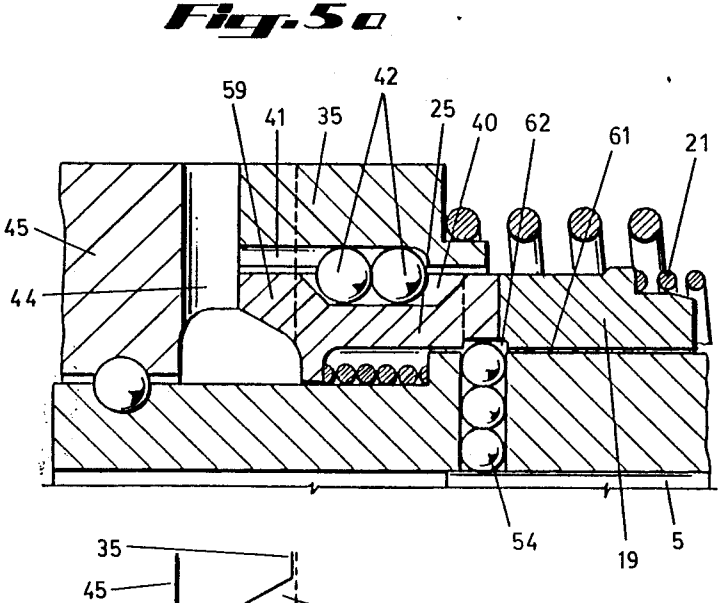
FIG. 5*a* is an axial section of the drive and torque connecting coupling assemblies when the driving member coupling part is moved towards the motor.
Figure 5B:
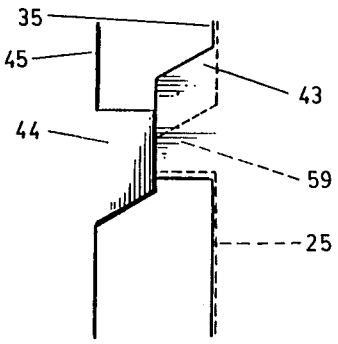
FIG. 5*b* is a schematic similar to FIG. 3*b* illustrating the torque connecting coupling assembly when the connecting coupling assemblies are in the position illustrated in FIG. 5*a;*

This position of first intermediate coupling part 25 vis-a-vis driven side coupling part 45 is shown in FIGS. 5*a* and 5*b*. The axial displacement of first intermediate coupling part 25 is also facilitated by ball-shaped coupling pieces 42. The axially parallel grooves 40 and 41 in intermediate coupling parts 25 and 35 are sufficiently long to make possible axial displacement of intermediate coupling parts 25 and 35.

Because first intermediate coupling part 25 is engaged with driving side coupling part 19, during the described axial displacement of first intermediate coupling part 25 on hollow spindle 17, first intermediate coupling part 25 is displaced axially against the force of pressure spring 21. Driving side coupling part 19 is lifted from its internally generated surface 61 with recess 62. After the axial displacement of first intermediate coupling part 25, driving side coupling part 19 is moved within the range of ball stop members 54. Ball stop members 54 can, due to the force of connecting tappet 5, move radially outwards, releasing connecting tappet 5. Due to the pressure existing in valve chamber 9 and due to the force of pressure spring 52, valve disk 12 and, consequently, connecting tappet 5, undergo axial displacement. Valve disk 12 bears with a sealing effect against valve seat 14 and interrupts the supply of compressed air to motor 4, which turns off. In FIG. 7, this happens at time $t_3$. Revolutions U of motor 4 drop to zero. During the time interval between $t_2$ and $t_3$, the described axial displacement of first intermediate coupling part 25 takes place. Because, at time $t_2$, the transfer of torque is interrupted, motor 4 can recover, i.e., its revolutions U can increase again. Shortly before reaching time $t_3$, a small peek rises in the $M_d$ curve. This peak is due to the fact that first intermediate coupling claws 59 of coupling part 25 strike against coupling claws 44 of driven side coupling part 45, so that, for a short time, a very small torque must be applied by motor 4 before claws 59 and 44 are disengaged in the described manner.

Figure 6:
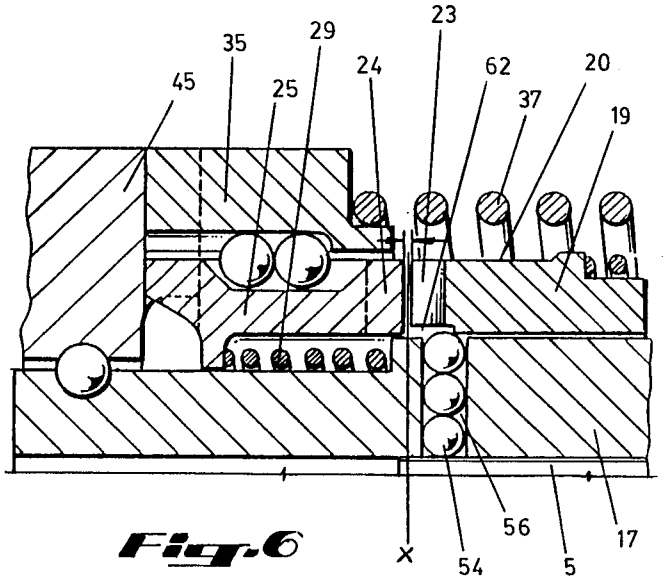
FIG. 6 is an axial section of the connecting coupling in the uncoupled position.

Because revolutions U of motor 4 increase again during the period between $t_2$ and $t_3$, the motor has sufficient energy to drive intermediate coupling parts 25 and 35, which rest with their claws 43 and 59 on claws 44, of driven side coupling part 45 until coupling claws 43 and 59 can enter the nearest gap between neighboring coupling claws 44 of driven side coupling part 45. This connecting situation is shown in FIG. 6. Thus, relative to driven side coupling part 45, intermediate coupling parts 25 and 35 take up their axial starting position. This axial displacement occurs from the force of pressure springs 37 and 29, as they are released.

In valve chamber 9, there remains sufficient air pressure so that valve disk 12 remains in its closed position and connecting tappet 5 locks ball stop members 54 in cross bore 56 of hollow spindle 17. Because external ball stop member 54 projects into recess 62 of driven side coupling part 19, it cannot be pushed back into its starting position. As a result, drive coupling assembly 20 remains in the position shown in FIG. 6, in which coupling claws 23 and 24 of first intermediate coupling part 25 and driving side coupling part 19 have safety clearance X. Consequently, all driving parts are perfectly separated from all driven parts. The residual kinetic energy observed on the motor side of driving side coupling part 19 which still remains in the moving parts, can be reduced without any impact on the torque already delivered to the driven parts. The axial displacement of first intermediate coupling part 25 and driving side coupling part 19 recurs during the period between $t_3$ and $t_4$ (FIG. 7).

Following the axial displacement of first intermediate coupling part 25 and driving side coupling part 19, valve chamber 9 can be ventilated by actuating valve 63 (FIG. 1). Pressure spring 11 forces rotary piston 10 and valve disk 12, back into their starting positions as shown in the lower portion of FIG. 2. The force of pressure spring 52 is smaller than the force of pressure spring 11. Connecting tappet 5, which is connected with valve disk 12, returns to its starting position shown in FIG. 3*a* so that ball stop members 54 may be released. Driving side coupling part 19, affected by the force of pressure spring 21, forces balls 54 radially inward, so that they reach the arresting and/or stop position shown in FIG. 3*a* and lock connecting tappet 5 against further axial displacement. Because ball stop members 54 are forced radially inward in cross bore 56, driving side coupling part 19 is released and is moved under the force of pressure spring 21, into its coupling position as shown in FIG. 3*a*. Thus the starting position according to FIG. 3*a* is reached again, so that the screw-tightening tool 100 may be restarted.

The connecting phases described according to FIGS. 3*a* through 3*c*, 4*a*, 4*b*, 5*a*, 5*b* and 6, occur within a fraction of a second, so that screw-tightening tool 100 can be disconnected instantaneously after completion of screw-tightening process.

The described screw-tightening tool 100 is characterized by the fact that, upon reaching its extreme torque, second connecting coupling assembly 36 is automatically disconnected, so that the transfer of torque is interrupted (FIGS. 4*a* and 4*b*) and motor 4, which continues running, no longer has any influence on the screw-tightening process. In this way, a tightened screw or nut, is always tightened to the desired tensile stress. Immediately after, compressed-air motor 4 is disconnected (FIGS. 5*a*, 5*b* and 6). The period between disconnection of the torque and disconnection of the compressed-air motor is determined by the slowing-down angle and/or slowing-down spacing 64 (FIG. 3*b*), which, in turn, is determined by the distance between the slanting faces 60 and 47 of coupling claws 59 and 44 of first intermediate coupling part 25 and driven side coupling part 45 in the operating position (FIGS. 3*a* and 3*b*). Because, in the screw-tightening tool 100 of the present invention, torque transfer is interrupted first, compressed-air motor 4 can recover before axial displacement of first intermediate coupling part 25, that is, its revolutions can increase. As a result, motor 4 still has enough energy to continue rotating the two intermediate coupling parts 25 and 35 relative to driven side coupling part 45, so that coupling claws 43 and 59 can again engage the next gap between neighboring claws 44 of driven side coupling part 45.

When the torque transfer is interrupted, coupling claws 23, 24 of driving side coupling parts 19 and first intermediate coupling part 25 of drive connecting coupling assembly 20 are still fully engaged. Only after driving side coupling part 19 and first intermediate coupling 25 are disconnected are coupling claws 23 and 24 released from each other. During this process intermediate coupling parts 25 and 35 are, biased by pressure springs 37 and 29, are returned to their starting position. As a result, practically no wear appears on coupling claws 23, 24 of driving side coupling part 19 and first intermediate coupling part 25.

As seen in FIGS. 3*b*, 4*b* and 5*b*, claws 59 of first intermediate coupling part 25 are shorter in a peripheral direction than claws 43 of second intermediate coupling part 35. Intermediate coupling parts 35 and 25 are arranged so that, during restoration of intermediate coupling parts 35 and 25, claws 59 of the radially inward-pointed first intermediate coupling part 25 are first released from coupling claws 44 of driven side coupling part 45, so that driven side coupling part 45 is pushed by the force of its spring 29 back into its starting position. The radially external second intermediate coupling part 35 falls with its coupling claws 43 between coupling claws 44 of driven side coupling part 45 only when first intermediate coupling part 25 has already been turned. As a result, coupling claws 59 of first intermediate coupling part 25 always lie at a distance from faces 49 of coupling claws 44 of driven side coupling part 45. This is important when screw-tightening tool 100 is driven in reverse. In such case, coupling claws 43 and 44 of second intermediate coupling part 35 and driven side coupling 45 bear against each other with their straight faces 48 and 49, while claws 59 of first intermediate coupling part 25 rest at a distance from coupling claws 44 of driven side coupling part 45. Therefore, coupling claws 59 need not be very rigid because they do not have to transfer torque from hollow spindle 17 to driven part 3.

If, instead of compressed-air motor 4, an electric motor is used, connecting tappet 5 may be displaced axially into its closing position by magnetic and/or electro-magnetic forces.

There is thereby provided by the power operated tool of the present invention a tool for stopping the screw-tightening process before any excessive plastic deformation of the screw occurs.

The foregoing embodiments are intended to illustrate the present invention and not to limit it in spirit or scope.

What is claimed is:

1. A torque limiting power operated screw-tightening tool comprising;

a driving spindle member;

a driven member;

means for connecting said driven member to said driving spindle member including:

a driving side coupling part axially coupled to said driving spindle member to receive torque therefrom, said driving side coupling part having a first set of claws;

a first intermediate coupling part slidably mounted on said driving spindle member having a second said set of claws constructed and arranged to engage said first set of claws on said driving side coupling part;

torque responsive means for biasing said first set of claws and said second set of claws together for the transmission of torque from said driving spindle member;

a second intermediate coupling part axailly coupled to said first intermediate coupling part to receive torque therefrom, said second intermediate coupling part having a third set of claws;

a driven member coupling part having a fourth set of claws constructed and arranged to engage said third set of claws on said second intermediate coupling part;

torque responsive means for biasing said third set of claws and said fourth set of claws together for the transmission of torque from said second intermediate coupling part;

whereby when a predetermined torque is reached the flow of rotational driving force between said driving spindle member and said driven member may be interrupted by first overcoming said torque responsive means for biasing said third set of claws and said fourth set of claws together and second by overcoming said torque responsive means for biasing said first set of claws and said second set of claws together.

2. The tool as defined in claim 1 wherein said second intermediate coupling part is axially displaced with respect to said first intermediate coupling part.

3. The tool as defined in claim 2 wherein said fourth set of claws engage said third set of claws following the direction of rotation of the tool.

4. The tool as defined in claim 1 wherein the mutually opposite faces of said first set of claws and said second set of claws are mutually parallel.

* * * * *